United States Patent [19]

Benoit

[11] Patent Number: 5,042,413

[45] Date of Patent: Aug. 27, 1991

[54] DEVICE FOR SEVERING UNDERWATER MOORING LINES AND CABLES

[76] Inventor: Leon Benoit, 4348 Sybil, New Orleans, La. 70122

[21] Appl. No.: 501,000

[22] Filed: Mar. 29, 1990

[51] Int. Cl.[5] ..... B63B 21/66

[52] U.S. Cl. ..... 114/244; 114/221 A; 114/245

[58] Field of Search ..... 114/221 A, 244, 245; 440/71, 73

[56] References Cited

U.S. PATENT DOCUMENTS 4,222,340 9/1980 Cole ..... 114/245

4,718,871 1/1988 Mendelevitch ..... 440/73

*Primary Examiner*—Sherman Basinger

*Assistant Examiner*—Thomas J. Brahan

*Attorney, Agent, or Firm*—Keaty & Keaty

[57] ABSTRACT

The invention relates to an underwater cable cutting device which is used in combination with a geophysical exploration apparatus carrying a depth control unit. The depth control unit is provided with guiding planes which are protected by the cable cutting device mounted ahead of the depth control unit. The cutting device has a generally flat body having a curved forward portion and a pair of hook-shaped cutting portions on opposite rearwardly extending sides of the flat body for deflecting a cable from the depth control unit and severing the cable or mooring line with its cutting surface formed by the hooked-shaped cutting elements. The device is attached to an elongated housing and abuts a securing shank of the depth control unit, without requiring any modifications to be made to the depth control unit.

10 Claims, 1 Drawing Sheet

DEVICE FOR SEVERING UNDERWATER MOORING LINES AND CABLES

BACKGROUND OF THE INVENTION

The present invention relates to a device for severing mooring lines and cables under water and more particularly the present invention relates to a device which is used in conjunction with an apparatus for controlling the depth of a marine cable, such as a geophysical exploration cable during marine seismic explorations. During such explorations a boat drags a length of a cable to which a plurality of depth control units are secured. The depth control units which are constructed with a pair of planes or "wings" which are transversely located on an elongated body of the control unit, so as to insure the desired submersion depth of the exploration cable which is critical in obtaining true and correct recordings of seismic conditions in the explorated area. It has been a continuous problem for such explorations that a number of mooring lines from fishing nets or buoys are present in the area of exploration, with the mooring lines, cables and the like cutting into the body of the guiding planes, often times damaging them to a degree, wherein the length of the cable has to be pulled out of the water and the control unit be replaced before the operation is resumed.

In order to solve the problem, a number of solutions have been offered, some of them consisting of providing the depth control apparatus with a deflection means which are mounted forwardly from the guiding planes, so as to deflect any possible obstruction away from the guiding planes and prevent the damage thereof. Other solutions include mechanical mechanisms or a combination of explosive and mechanical mechanisms which are released or otherwise actuated by a trigger upon contact with the mooring line or cables to be cut. Such devices, however, require a substantive modification of the cable depth control apparatuses to prevent damage to the impact sensitive guiding planes.

The present invention contemplates provision of a simple and inexpensive device for severing underwater mooring lines, cables and the like which can be easily adapted for use with the cable depth control apparatus.

SUMMARY OF THE INVENTION

It is therefore an object of the present invention to provide an inexpensive device for severing underwater mooring cables and lines.

It is another object of the present invention to provide a device for severing underwater cables which is easy to install and does not require any substantial modification of the cable depth control apparatus.

It is a further object of the present invention to provide a device for severing underwater cables which, at the same time, serves as a horizontal stabilizer for the depth control apparatus.

These and other objects of the present invention are achieved by providing a substantially flat body having a curved forward end portion. A pair of symmetrically positioned side portions extend outwardly and rearwardly at an angle to a transverse axis of the flat body. Two cutting portions are each formed on opposite ends of the flat body, with the cutting portions having a hook-shaped element which is curved towards the side portion and formes a cable passageway therebetween. A circular cutting surface formed by the hook-shaped element receives the cable after it was deflected from the front end along the side portions, through the passageway, and severs the cable or mooring line, as required. The flat body is further provided with a flat rear base portion, the longitudinal dimensions of which define the lateral dimensions of the total flat body. A cutout groove is formed centrally in the rear portion and extends forwardly therefrom. The cutout groove is sized and shaped to contact in abutting relationship an exterior periphery of a securing shank of a depth control unit, which is traditionally carried by an elongated housing of the geophysical exploration apparatus. A hole is formed through the body forwardly from the cutout groove, so as to receive a securing screw or bolt therethrough, thus attaching the cutting device to the elongated housing ahead of the depth control unit, the guiding planes of which have to be protected from the impact of the mooring lines or cables.

The flat body resembles a triangle with the rear portion serving as a base, while the curved forward portion serves as an apex of the triangle, with the hook-shaped cutting elements extending on both corners of the triangle adjacent the base.

Many advantages and features of the present invention will be readily appreciated by reference to the following detailed description of the invention taken in conjunction with the accompanying drawings.

DETAIL DESCRIPTION OF THE PREFERRED EMBODIMENT

Figure 1:
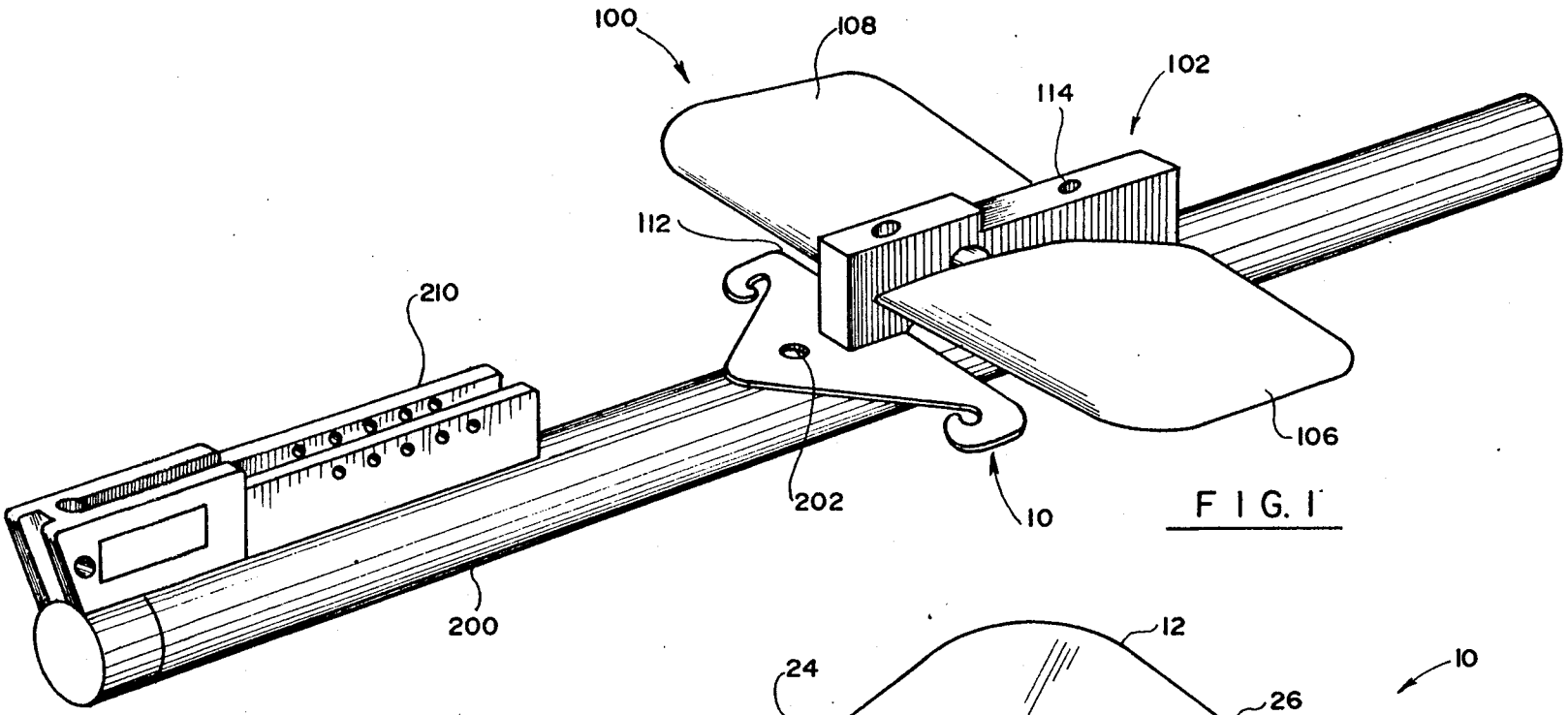
FIG. 1 is a perspective view of the device in accordance with the present invention mounted on a cable depth control apparatus.
Figure 2:
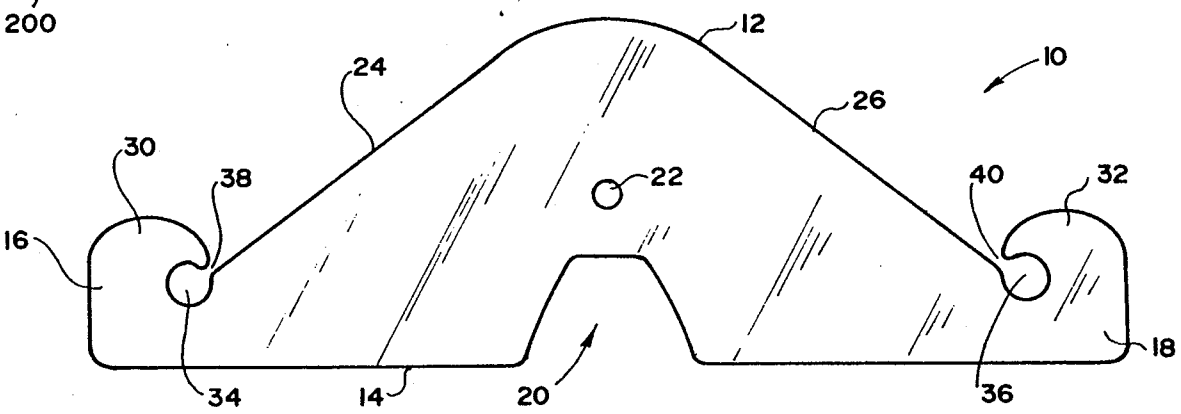
FIG. 2 is a perspective view of the device in accordance with the present invention.

Now referring the drawings in more detail, numeral 10 designates the device in accordance with the present invention and numeral 100 designates the depth control apparatus of the type currently available on the market and which does not form a part of the present invention. The cutter 10 has a curved forward end 12, a flat bearing rear portion 14 and a pair of opposite knife portions 16 and 18. Centrally formed in the back portion 14 and extending forwardly therefrom is a cutout groove 20, which allows positioning of the cutting device 10 about a supporting shank 102 of the depth control device 100, as will be addressed in more detail below.

Formed forwardly from the groove 20 and extending through the thickness of the cutter 10 is a securing aperture 22 through which a securing bolt or screw is passed for attachment of the device 10 to a cylindrical housing of the depth control device 100.

The forward end 12 curves backwardly and outwardly forming sides 24 and 26, which terminate adjacent to the knife portions 16 and 18. The sides 24 and 26 approximate the sides of a triangle, the base of which is the flat back bearing portion 14, and the apex of which is the curved forward end 12.

The knife portions 16 and 18 ar symmetrically positioned about a central axis of the cutter 10 and each is provided with a hook-like inwardly curved end 30 and 32, respectively. A cutout or aperture 34 of the knife portion 16 has a generally circular shape, with the passage 38 breaking the circumference of the cutout 34. The passage 38 is thus formed between the innermost tip of the hooked end 30 and the rearward end of the side 24. The knife portion 18, being symmetrical to the knife portion 16 is also provided with a circular cutout 36 with a broken circumference forming a passageway 40, which is formed by the tip of the end 32 and the side 26 of the cutter 10.

As can be seen in FIG. 1, the cable depth control apparatus 100 comprises a support shank 102 having an elongated body to which a pair of diving planes or "wings" 104 and 106 are securely attached. The diving planes extend sidewardly on opposite sides of the support shank 102 transversely to the longitudinal axis of the shank 102 and transversely to a longitudinal axis of the tubular housing 200 of the depth control apparatus 100. The diving planes 104 and 106 are connected to the shank 102 by diving plane shafts 108 (only one is seen in FIG. 1) which rotate relative to the shank portion 102 in response to a signal from a depth control unit positioned inside the shank 102 which, in turn, forces the guiding planes 104 and 106 to move with respect to horizontal plane depending on the ambient water pressure in order to control the depth of submersion of the apparatus 100 and the housing 200. The diving planes 104 and 106 are, therefore, adapted to tilt down to lower the seismic exploration cable in the water or tilt upwardly, guiding the cable closer to the water surface. The forward end of the supporting shank 102 is slightly curved and the cut out groove 20 of the cutter 10 is shaped and sized to configure to the exterior shape of the forward end of 112 of the shank portion 102. As shown in FIG. 1, the groove 20 allows the cutter 10 to fit the rear bearing portion 14 over the forward end portion 112 of the depth control apparatus 100. In this manner, no modification is required for the apparatus 100 which is available on the market and is currently used for seismic explorations.

As can be seen in FIG. 1, the shank portion 102 is detachably secured to an elongated tubular housing 200 with the help of a securing screw 114, which passes through the shank portion 102 into the wall of the housing 200. A connector screw 202 passes through the hole 22 in the cutter 10 into the co-aligned opening drilled in the body of the tubular housing 200 (the opening is not shown in the drawings), so as to securedly connect the cutter 10 to the body of the depth control apparatus. The cutter 10 is mounted ahead of the diving planes 104 and 106 in the direction of longitudinal movement of the towing cable and curves outwardly from a forward end 12 towards cutting knife portions 16 and 18. As will be appreciated, the horizontal plane on which the cutter 10 is mounted is below the plane which passes through the diving plane shafts 108 and 110, providing horizontal stabilizing effect on the elongated tubular housing 200, while extending on both sides of the tubular housing 200 in a fixed position to its longitudinal axis. The cutter device 10 decreases and absorbs rotational forces acting on the depth control apparatus and caused by wave motions, as well as by the pulling force transmitted by the towing cable which carries the depth control apparatus.

The tubular housing 200 also carries geophysical exploration device 210 which is mounted at the forward end of the housing end 200.

In operation, the depth control apparatus is secured to a towing cable and is towed along the area of exploration, such that the geophysical exploration device 210 senses seismic signals which are reflected from geological formations on the bottom of a body of water which is being explored. The sensing devices, such as hydrophones or geophones can be used for such purposes.

In operation, should the depth control apparatus mounted on the seismic exploration unit encounter a mooring line or cable the cutter forward end 12 contacts that cable and guides it along the sides 24 and 26 into the knife cutting portions 16 or 18. The circumference forming the cutout portions 34 and 36 can be suitably sharpened to further enhance cutting ability of the knife portions 16 and 18. Thus, the obstacle in the form of a mooring line and the like is deflected from the guiding planes 104 and 106, preventing damage to the guiding planes and substantially increasing the useful life of the depth control unit.

The cutting apparatus 10 is preferably formed from a non-corrosive material which is capable of withstanding high impact of a mooring line encountered at a speed of movement of the cable under water.

Many changes and modifications can be made within the design of the present invention without departing from the spirit thereof. I, therefore, pray that my rights to the present invention be limited only by the scope of the appended claims.

I claim:

1. An underwater cable cutting device for use with a geophysical exploration apparatus having an elongated housing carrying a depth control unit mounted thereon, said cutting device comprising:
   - a substantially flat body means having a curved forward end portion;
   - a pair of opposite side portions extending outwardly and rearwardly from said forward end portion;
   - a bearing base rear portion;
   - a pair of hook-like cutting portions disposed adjacent to rearmost parts of said opposite side portions, said cutting portions comprising a hook-shaped element curved towards said side portion and forming a cable receiving passageway therebewteen, said hook-shaped element further forming a generally circular cutting surface rearwardly from said cable receiving passageway; and
   - a means for detachably securing said device to said elongated housing forward from said depth control unit.

2. The device of claim 1, wherein said base rear portion is formed with a cutout groove sized and shaped to correspond to exterior periphery of a front end of a shank by which said depth control unit is secured to the elongated housing of said geophysical exploration apparatus.

3. The device of claim 1, wherein said flat body means is provided with an aperture forwardly from said cutout groove, the aperture being adapted to receive a securing screw therethrough to detachably secure the flat body means to the elongated housing of the geophysical exploration apparatus.

4. The device of claim 1, wherein said cutting portions are symmetrically disposed on opposite sides of a transverse axis of said flat body means.

5. The device of claim 4, wherein each of said side portions extends at an acute angle in relation to said transverse axis.

6. The device of claim 1, wherein said rear base portion defines lateral dimensions of said flat body means.

7. An underwater cable cutting device for use with a geophysical exploration apparatus having housing carrying a depth control unit mounted thereon, said cutting device comprising:

a substantially flat body having a curved forward end portion and having a transverse axis;

a pair of opposite side portions, each extending outwardly and rearwardly from said forward end portion at an acute angle in relation to said transverse axis;

a flat bearing rear base portion having a centrally located cutout groove;

a pair of hook-like cutting portions disposed adjacent rearmost parts of said opposite side portions, each of said cutting portions being symmetrically disposed on opposite sides of the transverse axis of said flat body and comprising a hook-shaped element curved towards said side portion and forming a cable receiving passageway therebetween, said hook-shaped element further forming a generally circular cutting surface rearwardly from said cable receiving passageway; and wherein said body is being provided with an aperture forwardly from said cutout groove for receiving a securing screw therethrough to detachably secure the flat body to the elongated housing of the geophysical exploration apparatus.

8. The device of claim 7, wherein said depth control unit is provided with a securing shank for securing the unit to said elongated housing and wherein said cutout groove formed in said rear base portion is sized and shaped to correspond to exterior periphery of a front end of the securing shank of said depth control unit.

9. The device of claim 7, wherein said rear base portion defines lateral dimensions of said flat body.

10. An underwater cable cutting device for use with a geophysical exploration apparatus having an elongated housing carrying a depth control unit mounted thereon, said cutting device comprising:

a substantially flat body means having a curved forward end portion;

a pair of opposite side portions extending outwardly and rearwardly from said forward end portion;

a bearing base rear portion;

a pair of hook-like cutting portions comprising a generally circular cutting surface disposed adjacent to rearmost parts of said opposite side portions; and a means for detachably securing said device to said elongated housing forward from said depth control unit.

* * * * *